United States Patent [19]

Zitz et al.

[11] Patent Number: 4,966,417

[45] Date of Patent: Oct. 30, 1990

[54] DEVICE FOR GUYING A DRIFT ADVANCING MACHINE WITHIN A DRIFT

[75] Inventors: Alfred Zitz, Zeltweg; Franz Bärnthaler, Weisskirchen; Erich Brandl, Grosslobming, all of Austria

[73] Assignee: Voest-Alpine Maschinenbau Gesellschaft m.b.H., Linz, Austria

[21] Appl. No.: 396,897

[22] Filed: Aug. 22, 1989

[30] Foreign Application Priority Data

Aug. 23, 1988 [AT] Austria ..... 2080/88

[51] Int. Cl.[5] ..... E21C 35/22; E21D 23/00

[52] U.S. Cl. ..... 299/33; 299/64; 299/76

[58] Field of Search ..... 299/29, 33, 76, 64; 405/138, 142

[56] References Cited

U.S. PATENT DOCUMENTS 3,493,058 2/1970 Zitko ..... 299/33

FOREIGN PATENT DOCUMENTS 968817 6/1975 Canada ..... 299/33
1534649 2/1969 Fed. Rep. of Germany ..... 405/138
825935 5/1981 U.S.S.R. ..... 299/33
881315 11/1981 U.S.S.R. ..... 299/29

*Primary Examiner*—Ramon S. Britts
*Assistant Examiner*—David J. Bagnell
*Attorney, Agent, or Firm*—Cushman, Darby & Cushman

[57] ABSTRACT

A device for guying a drift advancing machine within a drift has props which can be guyed between the drift roof and the drift floor and having articulated caps, connected to it. There are arranged at both sides of the longitudinal center plane of the machine at least one hydraulic cylinder-piston-aggregate between a supporting block fixed on the machine frame and the drift floor as well as between the supporting block and the drift roof in a guyable manner. The cylinder-piston-aggregates are articulatedly connected to floor supporting plates adapted to be pressed against the floor and to roof caps and are articulatedly connected to the supporting block, and the floor supporting plates and the roof caps are connected with the machine frame (1) via thrust supports.

7 Claims, 1 Drawing Sheet

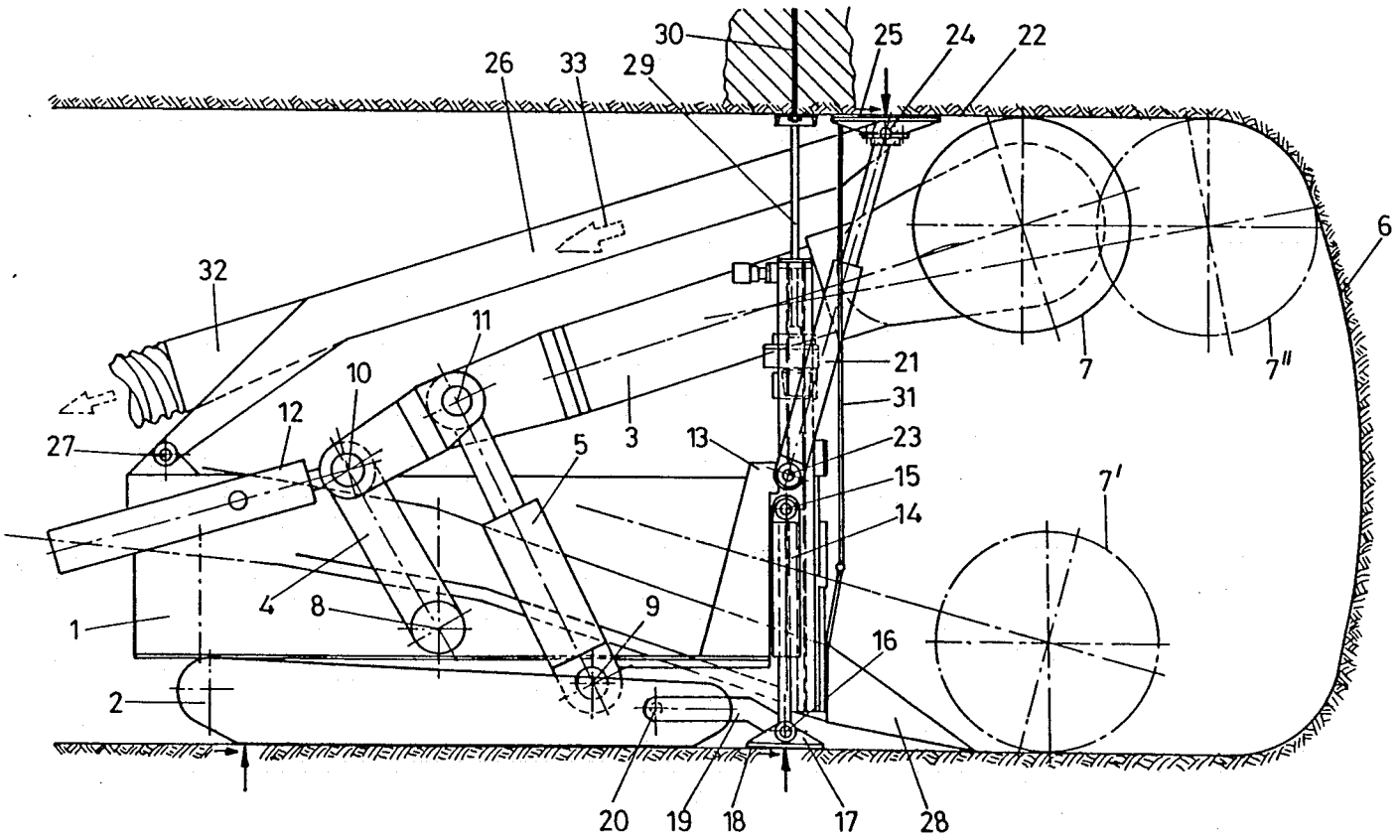
6
7''
7
7'
22
24
25
21
31
23
15
14
16
28
17
18
19
20
30
29
13
3
9
33
5
26
11
10
8
4
12
32
27
1
2

DEVICE FOR GUYING A DRIFT ADVANCING MACHINE WITHIN A DRIFT

BACKGROUND OF THE INVENTION

1. Field of the Invention

The invention refers to a device for guying a drift advancing machine within a drift, comprising props which can be guyed between the roof and the floor of the drift and having connected thereto articulated caps.

2. Description of the Prior Art

As a rule, props are used for guying a drift advancing machine within a drift, noting that there have become known arrangements in which the props, which are linked to the frame of a drift advancing machine, guy the roof of the drift with its floor. In such arrangements, the props or, respectively, the hydraulic cylinder-piston-aggregates are, in case of horizontally acting forces, subjected to bending load and such a bending load can only within limits be resisted by hydraulic cylinder-piston-aggregates. It has further become known to guy drift advancing machines directly against the drift roof by means of planar roof caps, noting that such an arrangement suffers from the drawback that anchors having already been placed in position can become damaged within the roof on account of the pressing force. In particular in case of fragile drift roofs it is of substantial importance to support the drift roof as far as possible adjacent the drift face, and such supporting means located adjacent the drift face give rise to problems because the free swivelability and movability of the cantilever arm need not be obstructed when effecting excavating work at the drift face. From the DE-PS 35 29 644 there has already become known an arrangement in which is supported on the loading ramp a wall element which can be guyed against the drift roof. Such an arrangement can be used as a protective means against rock lumps falling down, but an effective guying is, however, doubtful, last not least because the free manoeuvrability is restricted by effecting guying on the loading ramp and because the loading ramp shall be shifted at a suitable distance from the drift floor independent from the advancing machine for the purpose of effectively seizing fractured or cut rock. In addition, also in case of this known protective wall, the tension force required for erecting the wall is provided by cylinder-piston-aggregates connecting the drift roof with the drift floor and being again subjected to bending load in case of greater horizontal stress.

SUMMARY OF THE INVENTION

The invention now aims at providing a device of the initially mentioned type, which allows to reliably support transverse forces and horizontal forces without the danger of damaging the drift roof and the drift floor and with a simultanous reduction of the required pressing force acting against the roof and the floor. For solving this task, the device according to the invention comprises the features that at both sides of the longitudinal center plane of the machine there is arranged at least one hydraulic cylinder-piston-aggregate each between a supporting block fixed on the machine frame and the drift floor as well as between the supporting block and the drift roof in a guyable manner, noting that the cylinder-piston-aggregates are articulatedly connected to floor supporting plates adapted to be pressed against the floor and to roof caps and are articulatedly connected to the supporting block, and that the floor supporting plates and the roof caps are connected with the machine frame via thrust supports. On account of the floor supporting plates and the roof caps being connected with the machine frame via thrust supports, horizontal forces acting in longitudinal direction of the machine are directly received by these thrust supports, so that any bending load of the hydraulic cylinder-piston-aggregates is avoided. On account of separate cylinder-piston-aggregates articulatedly connected to a supporting block being used for the roof caps and for the floor supporting plates, the desired supporting force can directly be exerted by such cylinder-piston-aggregates, noting that, on account of horizontal forces being received by the thrust supports, the required respective contact pressure can be kept smaller. The subdivision of the hydraulic cylinder-piston-aggregates into separate cylinder-piston-aggregates for exerting a pressure force on the floor supporting plates, on the one hand, and for exerting a pressure force on the roof caps, on the other hand, provides the additional possibility to select the articulated joint of these cylinder-piston-aggregates such that, in particular a support located adjacent the drift roof can be selected, for which purpose it is sufficient to articulatedly link the cylinder-piston-aggregates exerting a contact pressure on the roof caps in a direction being inclined relative to the drift face. On account of connecting the roof caps with thrust supports, there is erected a supporting triangle, which has, in addition, the advantage that, when exerting a pressure force on the roof caps at a higher level or in case of greater cross sections of the tunnel or drift, the supporting point on the drift roof is shifted away from the drift face on account of the kinematics of the guide rod. This backward shift of the point of attack on the drift roof in case of higher levels considers in an optimum manner the condition that, also when swivelling a cantilever arm together with the associated excavating tools for example a cutting roll or cutting heads, in height direction, the relative distance or, respectively, the projection of the axis of the cutting tools onto the drift floor is backwardly shifted in axial direction of the machine, so that any collision of the cutting tools with the supporting means can reliably be avoided. It is in particular in case of telescoping cutting machines or drift advancing machines, in which the cutting head or the cutting roll, respectively, is supported for being shiftable relative to the machine frame in longitudinal direction of the drift, that the free space required for preventing any collision with the cutting tools can exactly be predetermined by suitably selecting the articulated joints and by suitable dimensions of the thrust supports.

The construction according to the invention is advantageously selected such that the articulated joints of the cylinder-piston-aggregates on the floor supporting plates and on the roof caps are connected with the machine frame via thrust supports being swivelable in height direction, noting that supporting directly at the articulated joints of the cylinder-piston-aggregates provides for a high degree of stability. For the purpose of keeping small the pressure acting per surface unit with simultaneous reliable support of the acting forces and for the purpose of avoiding any undesired loosening of the drift roof or of the drift floor on account of the guying, the arrangement is advantageously selected such that the floor supporting plates and the roof caps for the cylinder-piston-aggregates are designed as respective common supporting plates or caps extending over at least the width of the drift advancing machine. Such supporting plates or caps extending in transverse relation to the longitudinal direction of the drift in a continuous manner provide for the possibility to substantially uniformily receive the acting force over a greater superficial area, and, considering the circumstance that forces acting in horizontal direction are reliably received by the thrust supports, a high stability is obtained with a minimum contacting pressure.

The construction according to the invention is advantageously selected such that the thrust support connecting the articulated joints of the roof caps on the cylinder-piston-aggregates with the machine frame is swivelably linked in proximity of the rear end of the machine, noting that such a thrust support can, like the thrust support for the floor supporting plates, in a simple manner be cranked so that the movability of a cantilever arm for the cutting tools is not obstructed at all. Such a thrust support connecting the roof caps with the machine frame at the rear end of the machine can, in a particularly advantageous manner, be used to fulfill additional tasks and can simultaneously protect, like a protective shield, essential parts of the cutting machine against rock falling down. Simultaneously, the space required for anchoring work can be kept free by suitably selecting the width of such a thrust support, so that also subsequent anchoring work is not obstructed at all. For this purpose, the arrangement is advantageously selected such that the thrust support of the roof caps has, as seen in a plan view, approximately the width of the cantilever arm, noting that the thrust support can, in a simple manner, also be adapted to reliably accomodate dust removing devices, in particular a ventilating tube. For this purpose, the thrust support of the roof cap is advantageously designed as a box section of hollow interior for housing therein in a protected manner a dust-removing ventilating tube.

Also the floor supporting plate can, as already mentioned, advantageously be designed to extend over a greater width in transverse relation to the longitudinal direction of the machine, noting that the support required for receiving horizontal thrust forces can in a simple and reliable manner be obtained if the articulated joints of the floor supporting plate are at both sides of the caterpillar chassis connected with the machine frame by means of thrust supports being swivelably linked outside of the chassis and extending essentially in direction of the drift advancing machine. In this case it is of particular advantage that supporting is effected independent from the forces transmitted by a loading ramp into the drift floor, so that the loading ramp remains, with preselected positioning of the supporting elements and with predefined pressing force exerted by this supporting elements, freely movable and can be adjusted in accordance with the requirements existing for clearing the drift floor.

The horizontal forces are, with simultaneous substantial corresponding movement of the position of the supporting point on the drift roof in longitudinal direction of the drift in case of varying height of the drift, particularly reliably received if the articulated joints of the thrust support of the roof caps and of the swivelling axis for the vertical swivelling movement of the cantilever arm are arranged on the machine frame substantially at the same level above the running surface of the chassis or, respectively, above the drift floor. In this case, this thrust support is substantially parallely swivelled relative to the swivelling movement of the cutting arm in a reliable manner, because the swivelling point or, respectively, the articulating point of the thrust support is located at a high level, so that, when upwardly swivelling the cantilever arm for the cutting tools, there simultaneously results a displacement of the point of attack of the roof cap in longitudinal direction of the drift and relative to the operating point of the cutting tools in the same sense.

For the purpose of providing a reliable support, in particular in case of fragile drift roof, in proximity of the drift face, the arrangement is advantageously selected such that the thrust support of the roof caps is given a greater length as is the distance of the articulated joints of the hydraulic cylinder-piston-aggregates on the supporting block from the articulated joint of the thrust support of the roof caps on the machine frame. By such an arrangement, it can be made sure that the hydraulic cylinder-piston-aggregates for the roof caps become, under regular condition, effective in a position being swivelled in direction to the drift face, so that there can be obtained a supporting point of the roof caps which is, as seen in longitudinal direction and in a top plan view, located in front of the machine frame.

On account of the support according to the invention, higher cutting forces as usual can, based on the weight of an existing machine, be exerted and be transmitted into the support, so that there exists the possibility to increase the size of the cut material. In case of greater lumpiness of the cut material, there results simultaneously a reduction of the dust load.

The stabilization and the possibility to effect the drift consolidation substantially in synchronism with the drift advancing work or, respectively, the cutting operation, results in a still further increased security. The possibility to provide for a temporary support in proximity of the drift face and thus to support the drift roof in case of a particularly fragile drift roof equally results, in combination with the fact that the drift roof and the drift floor can thus substantially be spared on account of the reduced contact pressure and on account of increasing the supporting surfaces, in an improvement of the safety. It is in particular the support being shifted in forward direction and being independent from the machine operation which prevents the positioned anchors from becoming damaged and which provides the possibility to integrate, on account of the special design of the thrust support for the roof cap, a dust suction channel or, respectively, a ventilating tube.

BRIEF DESCRIPTION OF THE DRAWING

In the following, the device according to the invention is further explained with reference to an example of embodiment shown in the drawing.

In the drawing, there is shown a side elevation of a drift advancing machine comprising the inventive device for guying said machine within a drift between drift roof and drift floor.

BRIEF DESCRIPTION OF THE PREFERRED EMBODIMENT

In the drawing, there is indicated by the reference numeral 1 the frame of a drift advancing machine, which is movable on caterpillars 2. On the frame, there is arranged a cutting arm 3 for being liftable and lowerable in height direction via flaps 4 arranged at both of its sides and by means of cylinder-piston-aggregates 5, noting that for the purpose of cutting the drift face 6 there is provided a cutting roll 7 extending substantially over the width to be cut. The articulated joints of the flaps 4 and, respectively, of the cylinder-piston-aggregates 5 on the frame 1 are designated by the reference numerals 8 and 9, respectively, while the articulated joints on the cutting arm 3 are designated by the reference numerals 10 and 11, respectively. By actuating the cylinder-piston-aggregates 5 it is possible to lower the cutting roll 7 into the position 7' shown in dashed lines in the drawing. For the purpose of displacing the cutting arm in direction to the drift face there are provided further cylinder-piston-aggregates 12 which equally act on that articulated joint on the cutting arm 3, which is designated by the reference numeral 10. By actuating these cylinder-piston-aggregates 12 it is possible to displace the cutting roll 7 into the position designated by the reference numeral 7''.

For the purpose of guying the machine within the drift such that greater cutting forces can be introduced into the cutting roll 7 and such that the machine is stabilized during the cutting operation and that simultaneously the foremost section of the cut drift, not yet consolidated, is supported, there is provided on the frame 1 of the machine a supporting block 13 on which acts at both sides of the longitudinal center plane of the machine one cylinder-piston-aggregate 14 each, which is articulatedly linked to the supporting block 13 at 15 and is articulatedly linked to supporting plates 17 at 16, said supporting plate 17 being pressed against the drift floor 18 when extending the cylinder-piston-aggregates 14. On the articulated joint 16 of the cylinder-piston-aggregate at the floor supporting plate 17, there acts further a thrust support 19 being, one each, swivelably linked to the caterpillar chassis 2 at the outer side thereof and having its swivelling axis designated by the reference numeral 20. At both sides of the longitudinal center plane of the machine, there acts on the supporting block 13 of the machine frame 1 at least one hydraulic cylinder-piston-aggregate 21 for the purpose of guying the machine against the drift roof 22, noting that this cylinder-piston-aggregate 21 is swivelably linked to the supporting block 13 at 23 and is swivelably linked to the roof caps 25 at 24. As is the case with the articulated joint 16 of the floor supporting plate, a thrust support 26 acts on the roof cap 25 at the articulated joint 24 of the roof cap, noting that the second end of this thrust support 26 is articulatedly linked at 27 adjacent the rear end 1 of the drift advancing machine. The floor supporting plates 17 as well as the roof caps 25, which both can be pressed against the drift floor and, respectively, the drift roof by means of the cylinder-piston-aggregates 14 and, respectively, 21, are designed as supporting plates or caps extending at least over the width of the drift advancing machine so that greater forces can be resisted with smaller contacting forces by increasing the surface and a fragile drift roof is not subjected to excessive stress. A further improvement of the absorption of the forces acting on the cutting roll 7 and being transmitted onto the machine and being mainly effective in horizontal direction results on account of the supporting triangles being formed by the respective cylinder-piston-aggregates 14 and, respectively, 21 and of the respective cranked thrust supports 19 and, respectively, 26 and being articulatedly linked to the machine frame.

As a whole, there results an extremely space-saving arrangement of a guying means of a drift advancing machine in which the means guying the frame 1 against the drift floor 18 is independent from a schematically indicated loading ramp 28. On account of the supporting means for supporting the machine against the drift roof being, as is shown in the drawing, displaced in direction to the cutting roll, there results a support of the still not consolidated area of the drift roof immediately behind the cutting roll 7, and it is possible to erect within the area located immediately behind the roof cap 25 a permanent consolidation, as is indicated by the schematically indicated device 29 for boring anchor holes and placing anchors in position and by the anchor 30 at the foremost area of the frame of the machine. The cylinder-piston-aggregate 14 and, respectively, 21 can separately and mutually independent be actuated and thus be utilized in accordance with the requirements. For the purpose of protecting the machine, there is indicated in the drawing a cover wall 31 through which extends only the cutting arm 3. On account of articulatedly linking the thrust support 26 within the rear area of the machine frame and approximately within the level range of articulatedly linking the cutting arm 3 on the machine frame via flaps 4, it becomes possible to advance drifts of differing height without the necessity to adapt the guying means against the drift roof 22 according to the changed conditions, because the length of the cutting arm as measured from the articulated joint on the machine frame till the cutting rolls approximately corresponds to the length of the thrust support 26 between the articulated joints 27 and 24 and thus, also in case of a stronger inclination of the cylinder-piston-aggregate 21 and a corresponding displacement of the roof cap 25, an analogous movement of the cutting arm together with the cutting roll 7 takes place for a smaller height of the drift and thus any collision between roof cap and cutting tool becomes impossible. Simultaneously, the supporting effect provided by the roof cap 25 is reliably established immediately behind the cutting roll 7.

The supporting block 13 provided on the frame 1 for articulating thereon the cylinder-piston-aggregates 14 and, respectively, 21 is designed such that the cylinder-piston-aggregates embrace the cutting arm 3 at its respective outer sides, and the thrust support 26 of the roof cap 25 has, as seen in a top plan view, the width of the cantilever arm. The thrust support 26 is designed as a hollow box section for accommodating therein in a protected manner a dust removing tube 32, the sucked air being indicated by the dashed arrows 33.

What is claimed is:

1. Device for guying a drift advancing machine within a drift, comprising props which can be guyed between the drift roof and the drift floor and having connected thereto articulated caps, characterized in that at both sides of the longitudinal center plane of the machine there is arranged at least one hydraulic cylinder-piston-aggregate each between a supporting block fixed on the machine frame and the drift floor as well as between the supporting block and the drift roof in a guyable manner, wherein the cylinder-piston-aggregates are articulately connected to floor supporting plates adapted to be pressed against the drift floor and to roof caps and are articulately connected to the supporting block and comprising thrust supports for connecting the floor supporting plates and the roof caps with the machine frame, wherein the thrust support connecting the articulated connections of the roof cap on the cylinder-piston-aggregates with the machine frame is swivelably linked in proximity of the rear end of the machine.

2. Device as claimed in claim 1, wherein the thrust support of the roof caps has, as seen in a top plan view, approximately a width of a cantilever arm.

3. Device as claimed in claim 2, characterized in that the thrust support of the roof cap is a box section having a hollow interior for housing therein in a protected manner a dust-removing ventilating tube.

4. Device as claimed in claim 2, characterized in that the articulated connections of the thrust support of the roof caps and of a swivelling axis for the vertical swivelling movement of the cantilever arm are arranged on the machine frame at substantially the same level above the running surface of the machine chassis or, respectively, above the drift floor.

5. Device as claimed in claim 1 further comprising a caterpillar chassis, characterized in that the articulated connections of the floor supporting plate are at both sides of the caterpillar chassis connected with a machine frame by means of thrust supports being swivelably linked outside of the chassis and extending substantially in direction of the drift advancing machine.

6. Device as claimed in claim 5, characterized in that the thrust supports are swivable and of cranked design.

7. Device as claimed in claim 1, characterized in that the thrust support of the roof caps has a greater length than a distance of articulated connections of the hydraulic cylinder-piston-aggregates on the supporting block from the articulated connections of the thrust support of the roof caps on the machine frame.

* * * * *